US007074020B2

(12) United States Patent
Navarro

(10) Patent No.: US 7,074,020 B2
(45) Date of Patent: Jul. 11, 2006

(54) SANITARY PUMP AND SANITARY VALVE

(75) Inventor: Ramon M. Navarro, Orange, CA (US)

(73) Assignee: Cott Technologies, Inc., La Puenta, CA (US)

( * ) Notice: Subject to any disclaimer, the term of this patent is extended or adjusted under 35 U.S.C. 154(b) by 12 days.

(21) Appl. No.: 10/641,165

(22) Filed: Aug. 15, 2003

(65) Prior Publication Data

US 2005/0036896 A1 Feb. 17, 2005

(51) Int. Cl.
*F04B 39/00* (2006.01)

(52) U.S. Cl. ..... 417/454; 417/536; 137/542; 137/543.23

(58) Field of Classification Search ..... 417/534, 417/535, 536, 454; 137/543.23, 542, 540; 92/13.6, 13.5, 60.5
See application file for complete search history.

(56) References Cited

U.S. PATENT DOCUMENTS

| | | | | |
|---|---|---|---|---|
| 1,470,381 | A | 10/1923 | Lamb | |
| 1,777,293 | A | 10/1930 | Curtis et al. | |
| 1,867,585 | A * | 7/1932 | Moore | 417/536 |
| 1,932,976 | A | 10/1933 | Lamb et al. | |
| 2,051,100 | A | 8/1936 | Nelson | |
| 2,329,087 | A | 9/1943 | Russell | |
| 2,451,586 | A | 10/1948 | Strid | |
| 2,593,889 | A | 4/1952 | Kahl et al. | |
| 2,954,796 | A | 10/1960 | Marshall | |
| 2,962,975 | A * | 12/1960 | Camp | 417/536 |
| 2,996,077 | A | 8/1961 | Taggert | |
| 3,086,746 | A | 4/1963 | Holleron | |
| 3,370,759 | A | 2/1968 | Johansson | |
| 3,447,281 | A | 6/1969 | Buford et al. | |
| 3,707,987 | A * | 1/1973 | Gordon | 137/543 |
| 3,829,025 | A * | 8/1974 | McLeod | 239/373 |
| 4,008,012 | A * | 2/1977 | Page | 417/454 |
| 4,279,360 | A | 7/1981 | Hauser | |
| 4,575,313 | A | 3/1986 | Rao et al. | |
| 4,998,554 | A * | 3/1991 | Rogers | 137/217 |
| 5,425,397 | A * | 6/1995 | Mackal | 137/540 |
| 5,992,696 | A | 11/1999 | Schultz et al. | |
| 6,152,171 | A * | 11/2000 | Messick et al. | 137/543.13 |
| 6,634,871 | B1 * | 10/2003 | Ikuta | 417/466 |

* cited by examiner

*Primary Examiner*—Charles G. Freay
(74) *Attorney, Agent, or Firm*—Breneman & Georges; Todd A. Vaughn

(57) ABSTRACT

A sanitary pump and sanitary valve is provided employing a dual action piston for providing a constant pressure metering and delivery of fluids utilizing a drive shaft positively driven and controlled by a drive motor for sanitary applications. The sanitary pump may be fabricated from materials which do not include surface imperfections that would allow the growth of bacteria or allow the contamination of products that may be precisely metered by the sanitary pump. The sanitary pump includes sanitary check valves for opening and closing a high speed dependably and reliably and cycles up to 200 cycles per minute and preferably in the range of 60 to 160 cycles per minute by providing guides for maintaining check valve stem stability. The sanitary pump further includes compression seals for sealing the drive piston to maintain high reliability and dependability in high speed constant pressure applications.

34 Claims, 9 Drawing Sheets

SANITARY PUMP AND SANITARY VALVE

BACKGROUND OF THE INVENTION (1) Field of the Invention

The invention pertains to a constant pressure sanitary pump with sanitary check valves possessing metering capabilities. The novel sanitary pump and check valves are capable of rapid disassembly for cleaning and maintenance. The novel pump utilizes a drive shaft for operation of a double action piston head that is capable of reliable and high speed operation having components and check valves that may be removed from the pump and cleaned and quickly reassembled for sanitary hygienic filling operations as is required in the food handling and pharmaceutical processing arts.

The simplicity of the novel sanitary pump and sanitary check valves also provide for high speed pumping operations in pressure ranges of 400 pounds per square inch (p.s.i.) and greater and pumping cycles in the range of about 20 to 200 cycles per minute and preferably in a range of 60 to 160 cycles 20 per minute to provide virtually constant flow. The novel sanitary pump includes interchangeable check valves designed for high speed and reliable operation which can be rapidly removed and interchanged and are compatible with CIP (clean-in-place) cleaning as is required for sanitary pumps and metering operations in sanitary environments such as is found in the pharmaceutical and food processing industry with CIP (clean-in-place) cleaning.

The novel sanitary pump provides a double acting piston coupled to a drive shaft which may be interchanged for left hand or right hand drives or provides for driving from both sides by a drive shaft disposed through the pump housing. Adjustment of the stroke of the double acting piston may be provided in the drive shaft or the drive motor which can be of various types of mechanical drivers such as motors of various types, including electric motors, as well as pneumatic drive motors for the operation of the novel sanitary pump with metering capabilities.

(2) Description of the Related Art

The prior art includes a variety of pumps for transporting various types of fluid and semi-fluid products to a filling machine designed for dispensing food and dairy products in sanitary operations. In the prior art, the pump for transporting such fluid material to a separate metering and filling pump is generally referred to as a dosing or feed pump, which provides input feed to a metering and filling machine which in many cases employ a double action piston cylinder combination for alternately transporting the fluid product to a filler head under constant pressure.

The feed pump or dosing pump is generally of many different configurations and include screw conveyors, single acting piston cylinder pumps, pressurized vessels, and other devices for supplying fluid under pressure to a metering filling machine which then employs a double acting piston for metering and transferring the fluid to fill heads. The known prior art has not combined a feed pump and a double acting constant pressure metering machine into a single constant pressure pump with metering capabilities for application in the food processing industry for filling containers with various food products such as milk, yogurt, cream, cream cheese, and other viscous products so that the fill product is delivered from the metering filling machine by a constant pressure sanitary pump to the fill heads.

The prior art metering filling machines typically employ a double acting piston cylinder combination and a combination of valves and adjustment mechanisms for metering the amount of fluid to a fill head. Representative prior art of metering filling machines include Lamb et al. U.S. Pat. No. 1,932,976, Lamb U.S. Pat. No. 1,470,381, Buford et al. U.S. Pat. No. 3,447,281, Curtis et al. U.S. Pat. No. 1,777,293 and Johanssen U.S. Pat. No. 3,370,759. These metering filling devices utilize a double acting piston for providing constant pressure operation for use in the food processing industry, i.e. Lamb et al. U.S. Pat. No. 1,932,976 and Buford et al. U.S. Pat. No. 3,447,281.

The prior art metering filling machines are not pumps, but instead include a pressure differential activated piston cylinder combination having rods disposed axially through the ends of the cylinder wall for determining the position of the piston head and operating the valves for a substantially free floating piston head. Johanssen U.S. Pat. No. 3,370,759 employs a free floating piston head without rods or shafts extending through either end wall of the cylinder and provides a truly free floating piston head which like the other prior art metering filling machines are activated by fluid pressure differential acting upon either side of the piston head.

Unlike the prior art, the novel sanitary pump utilizes a positively controlled pump drive shaft and does not employ a free floating piston head or a piston with a head for operation in a free floating pressure differential environment. The invention in marked contrast to the prior art, provides a double acting piston head cylinder combination having at least one drive shaft connected to the piston head for positively controlling and driving the piston head in the cylinder. The novel sanitary pump further includes metering capabilities, like the prior art, but in contrast to the prior art, the metering capabilities of the sanitary pump of the invention are achieved by positively controlling the position of the piston head within the cylinder of the novel sanitary pump.

The prior art metering and filling machines, instead of utilizing a drive shaft, utilize piston rods or shafts that extend through the end walls of the cylinders to adjust the position of the piston head in the cylinder or to activate various valving mechanisms to open or close various types of ball valves, tapered valves, such as in Lamb et al. U.S. Pat. No. 1,470,381, or pneumatically controlled valves such as in Buford et al. U.S. Pat. No. 3,447,281 for admitting pressurized fluid into the pressure differential operated piston head. The prior art valves utilized in the prior art metering and filling machine are not check valves and do not provide for high cycle pumping operations. Prior art valves of various designs and configurations while suitable for the metering and filling of machines, the prior art are not suitable for the high pressure, rapid cycled pumps of the invention.

The prior art also includes various types of manifold and valve arrangements for the double acting metering piston head cylinder combinations. Examples of such manifolds are included in Lamb et al. U.S. Pat. No. 1,932,976 and Shultz et al. U.S. Pat. No. 5,992,696. These manifolds and valves do not include check valves and such valves do not provide stem guide means and seat guide means for preventing radial motion of the valve. Furthermore, the valves of the prior art do not include check valves that are opened and closed by the positive pumping action of a positively controlled pump drive shaft connected to the piston head which positively drives and controls the operation of the piston head in response to the drive motor. The prior art check valves are designed to operate by the indirect pressure from a feed pump or dose pump imparted upon a substantially free floating piston head in a metering and filling machine as opposed to the direct pumping action of a pump drive shaft.

The novel sanitary pump of the invention utilizes reliable high speed sanitary check valves designed to open, close and obviate the problems of wear and tear encountered in a high pressure operation of up to 400 pounds per square inch (p.s.i.) and greater and high speed operation of from about 60 to 160 cycles per minute and up to 200 or more cycles per minute. The novel sanitary pump and sanitary check valves are designed for reliability as well as being easily cleaned by CIP (clean-in-place) procedures as well as being easily taken apart for periodic cleaning operations. CIP operations in food and pharmaceutical operations presume cleaning without disassembly, although ease of disassembly provides advantages in replacing parts or rapidly removing and replacing components or parts in the event of contamination.

The prior art does not include a sanitary pump having detachably sealable ends having a positively controlled piston head controlled by a drive motor of an electrical, gasoline or pneumatic configuration which positively controls the position of the piston head. The prior art has not provided a double acting sanitary pump having a sanitary check valve capable of high speed dependable operations for high speed cycles from 60 to 160 and up to 200 cycles per minute or more depending on the positively controlled piston head. The prior art has also not provided a novel seal for providing a compression sealing of the piston control shaft in one or both ends of the novel detachable and easily cleanable sanitary pump and sanitary valves by CIP or rapid disassembly into their component parts.

SUMMARY OF THE INVENTION

One of the objects of the invention is to provide a sanitary pump having metering capabilities for providing a constant pressure filling operation in a sanitary environment utilizing a double action piston head. The requirements for a sanitary piston pump in a sanitary environment include reducing the number of parts of the sanitary pump to a bare minimum and having all parts capable of clean-in-place operations for periodically cleaning the sanitary pump, as well as the ability to rapidly disassemble the sanitary pump into its component parts. The requirements further include seamless unthreaded components made of stainless steel or other material that can be easily disassembled, sterilized and reassembled back into a working condition.

Another object of the invention is to provide a constant pressure sanitary pump that is reliable and capable of high speed operations in the range of about 60 to 160 cycles per minute and pressures up to about 400 pounds per square inch (p.s.i.) or greater that includes a piston head driven by a drive shaft that provides a constant pressure operation capable of precise measuring and dispensing of fluid filled materials in a constant pressure filling operation.

Still a further object of the invention is to provide a sanitary pump that has a minimum of parts that are interchangeable and can be quickly and easily set up, reconfigured and repaired, that can accommodate a right hand drive motor, a left hand drive motor, or both, and that can be easily transported in component parts and set up in the field and provide reliable constant pressure pump operation.

A further object of the invention is to provide a pump and preferably a sanitary pump having a minimum of seals that are readily replaced and easily adjusted in a double acting constant pressure pump.

It is an even further object of the invention to provide a sanitary pump that accommodates a wide range of fluid dispensing operations which within the size and limits of the pump capacity can be modified by adjusting the length of the drive shaft, the linkage connecting the drive shaft to the drive engine or the engine for driving the drive shaft to provide adjustments of the volume of fill materials.

Yet a further object of the invention is to provide a pump and preferably a sanitary and metering pump that does not depend upon the physical characteristics of the fluid such as compressibility of the fill substance for operation of the piston head, but instead provides a positive control over the piston head through the use of an associated drive motor for driving the piston drive shaft of the novel sanitary pump to dispense the fluid without the introduction of air, turbulence and cavitation that destroy an accurate metering of fill materials. In achieving this object it is also an object to control the stroke of the associated drive motor to within limits to provide further control over the amount of dispensed fluid.

These and other objects of the invention are achieved by the novel sanitary pump and sanitary valves which can be easily disassembled into their component parts. The novel sanitary pump includes a substantially cylindrical shaped housing body having a first removably sealable end and a second removeably sealable end with inlet and outlet ports disposed intermediate the removeably sealable ends or disposed in the removeably sealable ends. A piston head is disposed intermediate the inlet and outlet ports and is driven by a drive shaft disposed in substantial axial alignment with the substantially cylindrical pump housing having at least one of the detachably sealeable ends having wiper seals and an adjustable tensioning means for adjustably tensioning the wiper seals around the drive shaft to provide a constant pressure pump having a drive shaft driven by a motor means which preferably includes adjustment means for adjusting the length of travel of the piston head in the novel piston pump.

The reliability of the novel high speed constant pressure sanitary pump is provided by employing a plurality of interchangeable novel check valves preferably detachably mounted to the inlet and outlet ports of the novel constant pressure pump. The novel sanitary check valves required for high speed and dependable operation include spring biased check valves having a stem guide for limiting the movement of the check valve and a valve seat guide for limiting the radial movement of the check valve. The sanitary check valves are responsive to the pressure provided by the drive motor operating the piston drive shaft to open and close in response to the operation of the drive shaft by opening and closing at high rates of speed to up to 200 cycles per minute or more while providing long term reliability.

The novel check valve in its preferred configuration is disposed in an upper and lower or clam shell type housing having a valve stem surrounded by a spring constrained in a guide cavity for guiding the stem during the compression of the spring while the seat end of the check valve includes a seal and collar guide having an opening for accommodating flow within the collar while providing a guide at the opposite end for maintaining the check valve in a substantial parallel alignment with the stem constrained in place by a combination of the compression of the spring and spring guide cavity.

In the best mode of the invention, the sanitary check valve includes a fully detachable upper and lower housing held together by flanges as well as at either end of the upper and lower housings for connection to one of the ports of the novel constant pressure pump. Preferably, each of the flanges can be clamped together with a flange clamp and sealed with an O-ring.

The novel pump of the invention may be used not only in sanitary operations but all high speed high capacity pumping operations particularly where a constant pressure is desired. The novel high speed constant pressure pump can be configured with a single drive shaft for right and left hand applications since the pump housing is symmetrical and the end plates closing the substantially cylindrical housing can be interchanged. The novel sanitary constant pressure pump can include two drive shafts extending from opposite ends of the piston head to not only provide for right and left drive operations, but also to equalize the volume on both sides of the double acting piston of the novel piston sanitary pump to assist in balancing the volume of fluid metered from the novel sanitary pump.

The novel double acting piston pump may further include drive stabilize mechanisms to stabilize and maintain a horizontal reciprocal operation of the drive shaft to prevent wearing of the seals and may also include adjustment mechanisms and linkages for adjusting the position of the piston head in the novel sanitary pump. The compact design of the novel constant pressure pump allows for applications of the constant pressure pump in a parallel or tandem operations for increasing pumping throughput and capacity utilizing the novel design and components of the novel sanitary pump.

These and other advantages of the invention will be further recognized from the accompanying brief description of the drawings as well as the detailed description of the invention.

BRIEF DESCRIPTION OF THE DRAWINGS

The objects and advantages of the invention will become more apparent to those skilled in the art from the following detailed description of the invention in relation to the accompanying drawings in which.

DETAILED DESCRIPTION OF THE INVENTION

The advantages inherent in the novel sanitary pump of the invention reside in its simplicity of design, interchangeable parts, novel sealing arrangement for the drive shaft and high speed sanitary and interchangeable check valves which allow the novel sanitary pump to operate at speeds up to and exceeding 200 cycles per minute utilizing a positively controlled drive shaft. It will be recognized the same advantages in simplicity in design, interchangeability of parts and the rapid disassembly of the components provide for clean-in-place (CIP) advantages required for dispensing fluid materials in the food processing and pharmaceutical industry.

These advantages of the novel sanitary pump are further augmented by the utilization of stainless steel, glass, high density plastic or other material in the fabrication of the novel pump and components that are compatible with high purity material handling requirements in components substantially free from cracks, seams, threads and other components that would capture and provide breeding surfaces for bacteria or other deleterious substances. These same clean-in-place and disassembly advantages allow the novel sanitary pump and sanitary valves to be disassembled and transported easily to remote locations and set up for pumping operations in either sanitary or non-sanitary environments or applications where reliability, high pressure, high flow and particularly a constant pressure pump is desired.

Figure 1:
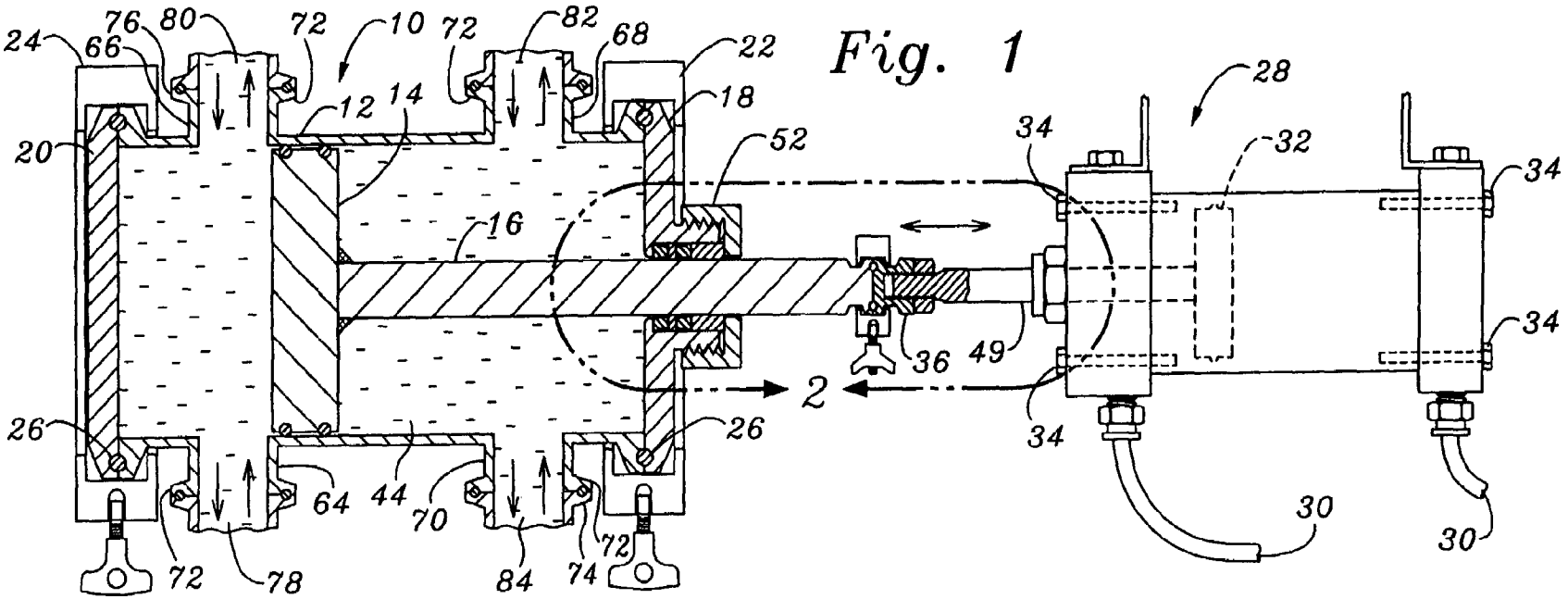
FIG. 1 is a side elevational view partly in section illustrating the novel sanitary pump of the invention.
Figure 2:
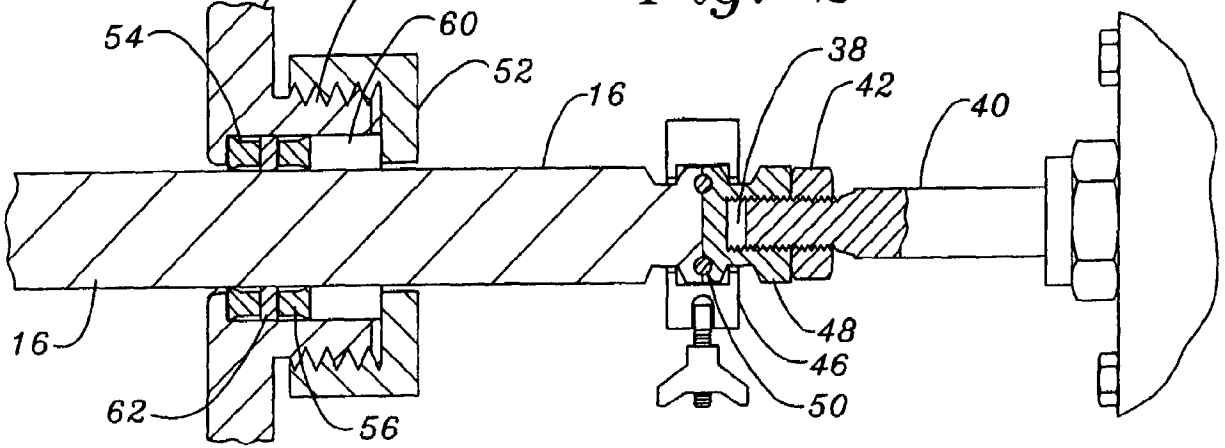
FIG. 2 is an enlarged view of the sanitary pump along reference line 2—2 illustrating a portion of the drive shaft and novel sealing arrangement of the novel sanitary pump.
Figure 3:
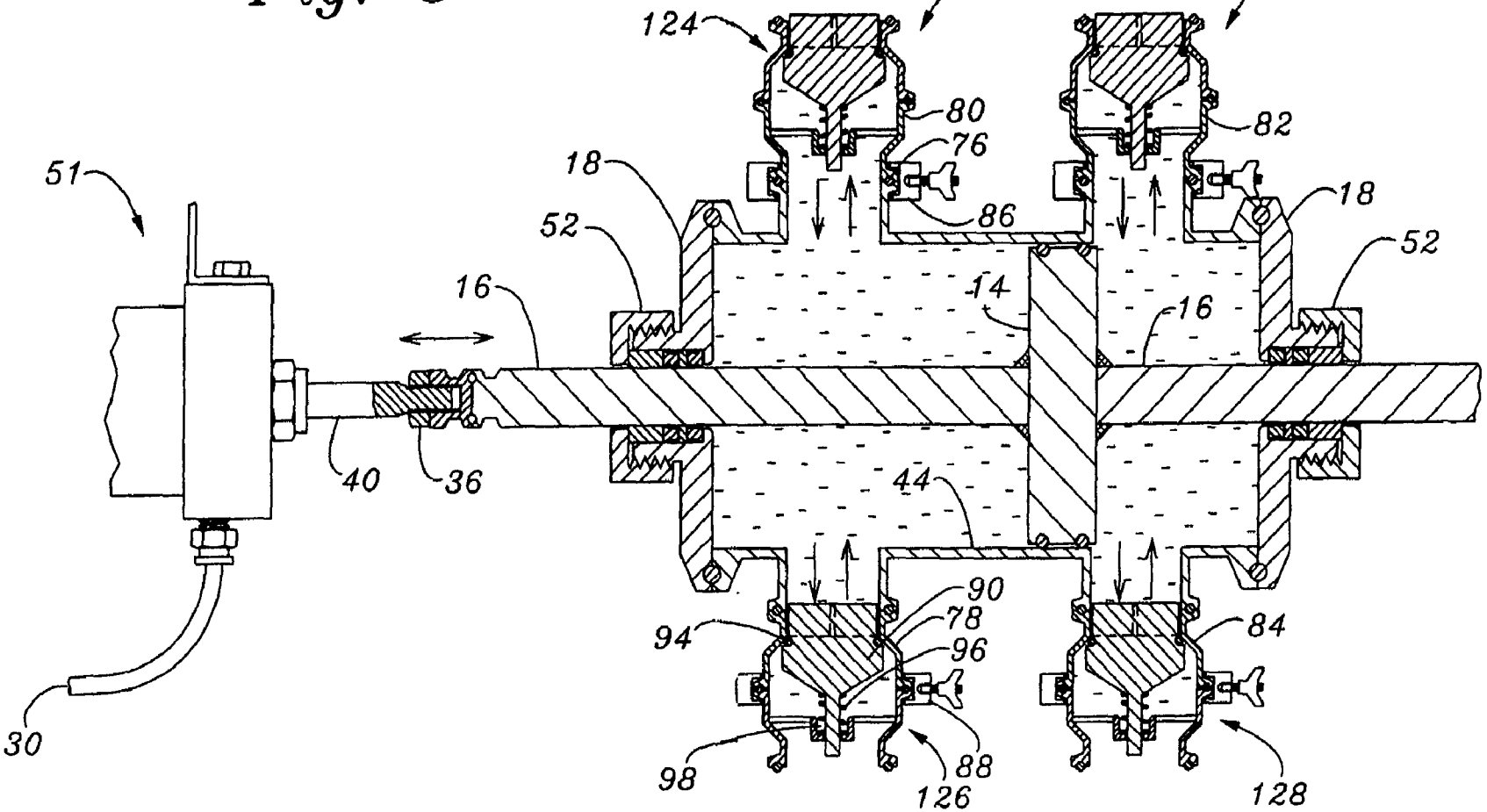
FIG. 3 is an alternative embodiment of the novel sanitary pump of FIG. 1 including a dual drive shaft and associated detachable sanitary check valves of the novel sanitary pump.

Referring now to FIGS. 1–3 a novel sanitary pump 10 in accordance with the best mode of the invention is illustrated. The novel sanitary pump 10 contains a substantially cylindrical housing 12 for accommodating a double acting piston head 14 driven by a drive shaft 16 disposed in substantial axial alignment with the cylindrical housing 12. The interchangeable, removable and detachably sealable cylindrical plates 18 and 20 are provided to close the ends of the substantially cylindrical housing 12.

Interchangeable, removable and detachable cylindrical plates 18 and 20 are secured to the substantially cylindrical housing 12 in the preferred embodiment by removeably detachable clamps 22 and 24 which may be flange clamps or tri-clover clamps to seal the ends of the substantially cylindrical housing 12 by means of O-rings 26. The interchangeable, removable and detachable sealable cylindrical plates 18 and 20 are preferably utilized so that plate 18 may be placed on the opposite end of substantially cylindrical housing 12 and plate 20 may be placed at the opposite end of cylindrical housing 12 to allow drive motor 28 to drive shaft 16 of the novel sanitary pump 10 from the left side as opposed to the right side as illustrated in FIG. 1.

Drive motor 28 can be any type of motor to provide reciprocal motion for driving drive shaft 16 reciprocally within housing 12. In the preferred embodiment, drive motor 28 is a pneumatically activated motor having air inlets 30 and corresponding air outlets (not shown) for driving piston head 32. Drive motor 28 may include means for adjusting the reciprocal travel provided for drive shaft 16 such as adjustment screws 34 or adjustment valves for adjusting the length of stroke of drive motor 28. In addition to adjustment means 34 on drive motor 28 various other types of adjustment means for changing the length of the stroke of drive shaft 16 may be utilized such as linkages, levers and others mechanical means for adjusting the length of the stroke of drive shaft 16 which can be calibrated to adjust the travel of double acting piston head 14 within substantially cylindrical housing 12. In addition to adjustment means 34 for adjusting the length of the stroke of motor 28, a further adjustment means 36 is provided at the end of drive shaft 16. The adjustment means 36 provided on drive shaft 16 may include a threaded opening 38 into which threaded shaft 40 of drive motor 28 may be adjusted by the utilization of adjustment nut 42 (FIG. 2).

Adjustment means 36 alone or in combination with an adjustment means 34 on drive motor 28 is designed to control the exact position of double acting piston head 14 in cylinder 44 to assist in precisely metering fluids pumped by the novel sanitary pump 10. In sanitary pump applications, a clamp 46 is designed to connect drive shaft 16 to a threaded shaft 40 of shaft 49 by a nut 48 having a threaded opening 38. Nut 48 is held in place by clamp 46 with an O-ring seal 50.

Figure 12:
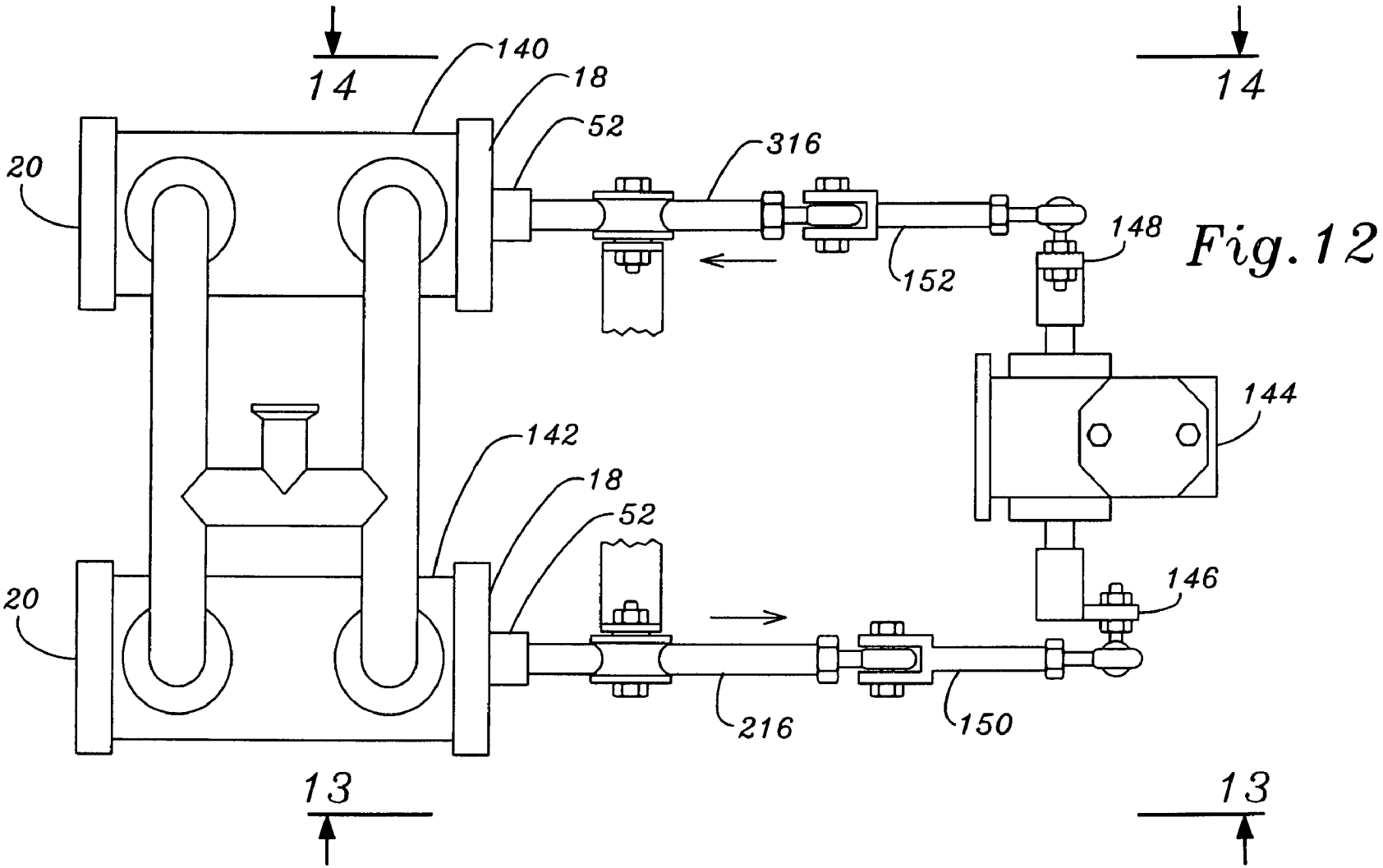
FIG. 12 is a top plan view of a pair of novel sanitary pumps disposed in a parallel pumping arrangement activated by a single drive motor.
Figure 14:
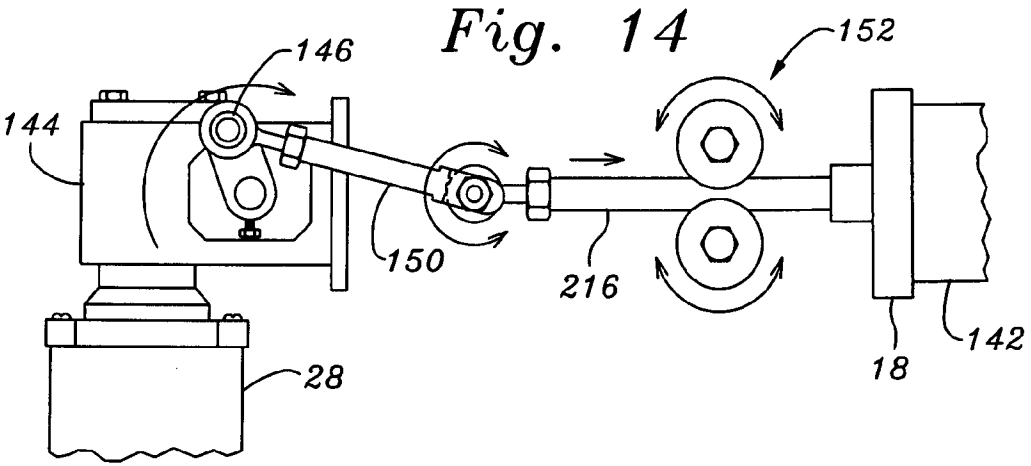
FIG. 14 is a portion of the novel sanitary pump and drive motor arrangement illustrating a stabilizing means for the drive piston of the novel constant pressure pump.
Figure 13:
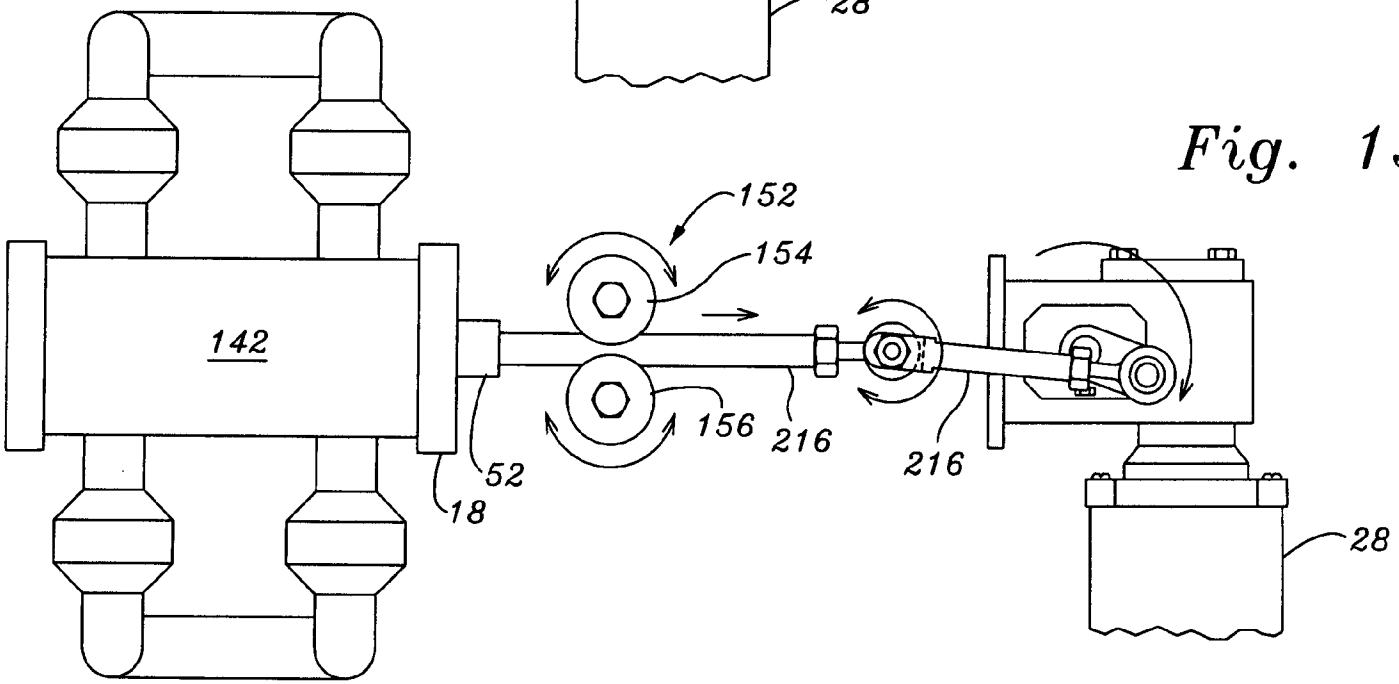
FIG. 13 is a side elevational view of FIG. 12.

Referring now again to FIGS. 1–3 the novel sealing arrangement for sealing drive shaft 16 within interchangeable, removeably and detachably sealable cylindrical plate 18 includes a compression nut 52 for compressing the seals 54 and 56 against drive shaft 16. Compression nut 52 is adjustably secured to plate 18 by threads 58 to provide for the compression of bushing 60 against seals 54 and 56, as well as a compression washer 62 disposed between seals 54 and 56. Seals 54 and 56 are preferably a loaded lip seals or seals that have a lip on it such as cap seals, V-ring seals, quad seals or other types of O-ring seals having a flat surface to provide for a compression and wiping against shaft 16. The combination of a loaded lip seal together with compression nut 52 provides a tight reliable seal, which may be augmented by a drive shaft stabilizing device, as will be described hereafter in greater detail with respect to FIGS. 12–14.

Referring now to FIG. 3 an alternative embodiment of the best mode of the invention is illustrated in which drive shaft 16 has been extended in both directions from double acting piston head 14 and interchangeable, removable, detachably sealable cylindrical plate 18 has been utilized on the seal both ends of cylinder 44. The advantages of the alternative embodiment as illustrated in FIG. 3 include the fact that drive rod 16 can be either driven from the left side, as shown in FIG. 3, or from the right side by utilizing a drive motor 28. The alternative embodiment as illustrated in FIG. 3 further allows the volume on both sides of double acting piston head 14 to be substantially the same or equalized to assist in the precise pumping and metering of dispensed fluids. The positive control over drive shaft 16 by drive motor 28, and hence piston head 14 is markedly different than the prior art since the novel sanitary pump 10 maintains positive control over the pumped fluid and does not depend upon the physical characteristics over the pumped fluid such as density and compressibility of the dispensed fluid to provide an accurate pumping and metering of the dispensed fluid.

Referring again to FIGS. 1–3 the substantially cylindrical housing 12 includes a pair of inlet/outlet ports 64 and 66 disposed on one side of piston head 14 and a second pair of inlet/outlet ports 68 and 70 on the other side of piston head 14. The provision of a pair of inlet and outlet ports, in combination with check valves as will be described hereinafter allows the novel sanitary pump 10 to efficiently pump fluid without entrapping air and to reduce turbulence and cavitation to substantially eliminate frothing and/or other physical disturbances of pumped fluid that would otherwise detract from the metering capabilities of the novel sanitary pump 10.

The inlet/outlet ports 64, 66, 68 and 70 in sanitary pumps terminate in flanges 72 for accommodating a similar flange 74 for sealing with an O-ring 76. The flanges 72 are designed to accommodate a corresponding flange on a detachably separable check valve housing 78, 80, 82 and 84. The detachably separable check valve housing (FIG. 3) are held in place by clamps 86 and 88 and sealed by O-ring 76.

Referring now to FIGS. 3–11 the components of the detachably separable check valve housing 78, 80, 82 and 84 in the novel sanitary pump 10 is illustrated. Each of the detachably separable check valve housing 78, 80, 82 and 84 are interchangeable and may be rapidly and quickly removed and disassembled or replaced on the novel sanitary pump 10. The detachably separable check valve housing 78 can be taken apart by removing a flange 88 to disassemble or replace the components of check valve 90. The check valve is constrained within a separable lower check valve housing 92 that includes upper and lower valves sealed by an O-ring and held together with flange clamp 88. The lower end of the check valve housing includes an O-ring seal 97 while the check valve 90 includes at the lower end an O-ring seal 94 and at the upper end a spring 96 captured within a cavity 98 disposed within check valve guides 100 (FIGS. 7 and 8) housed by detachably separable check valve housing 78. O-ring seal 94 on the check valve (FIG. 11) seals and protects the seal area. In the preferred embodiment of the invention check valve guide 100 may be removed from detachably separable check valve housing 78 for cleaning.

The configuration of the novel check valve is best illustrated in FIGS. 8–11 which illustrate the arrangement of the check valve in open position (FIG. 8) and closed position (FIG. 7) for the novel sanitary pump 10. One half of the check valve housing 78 terminates in a flange 101 with a groove for an O-ring 102 for mating with a similar flange and groove on novel sanitary pump housing 10. As heretofore indicated, a flange clamp 88 connects the two halves of the detachably separable check valve housing 78 to sanitary pump 10 via flanges 104 and an O-ring 95 housing 78. Separable check valve housing 102 is designed to closely fit around the bottom check valve seat 106 of check valve 90 so that when check valve 90 is in an open position (FIG. 8) the constraining walls of the separable check valve housing 92 are designed as a guide to limit radial movement and maintain check valve 90 in a radially constrained position. The lower guide in limiting radial movement cooperates with spring 96 which as the spring compresses into cavity 98 guides the check valve stem into cavity 98 along with spring 96 and together with constraining walls 108 and check valve seat 106 holds the check valve in axial alignment so as to prevent wobbling or radial movement which otherwise destroys or prevents the check valve from operating in a high speed environment such as is required for check valves operating around or above 200 cycles per minute and generally in a range from 60 to 160 cycles per minute.

The check valve stem guide support 100 also includes a tight collar 110 for maintaining and guiding the stem of check valve 90 in a substantial axial position. The thickness of collar 110 can also be utilized to assist in maintaining the check valve in substantial axial alignment. The check valve stem guide support 100 also includes vanes 112 which allow products to move through the check valve as illustrated by arrows 114. The check valve seat 106 also include vanes 118 and openings for allowing fluid to pass around and through the sides of bottom stem 106 as illustrated by arrows 120.

Figure 4:
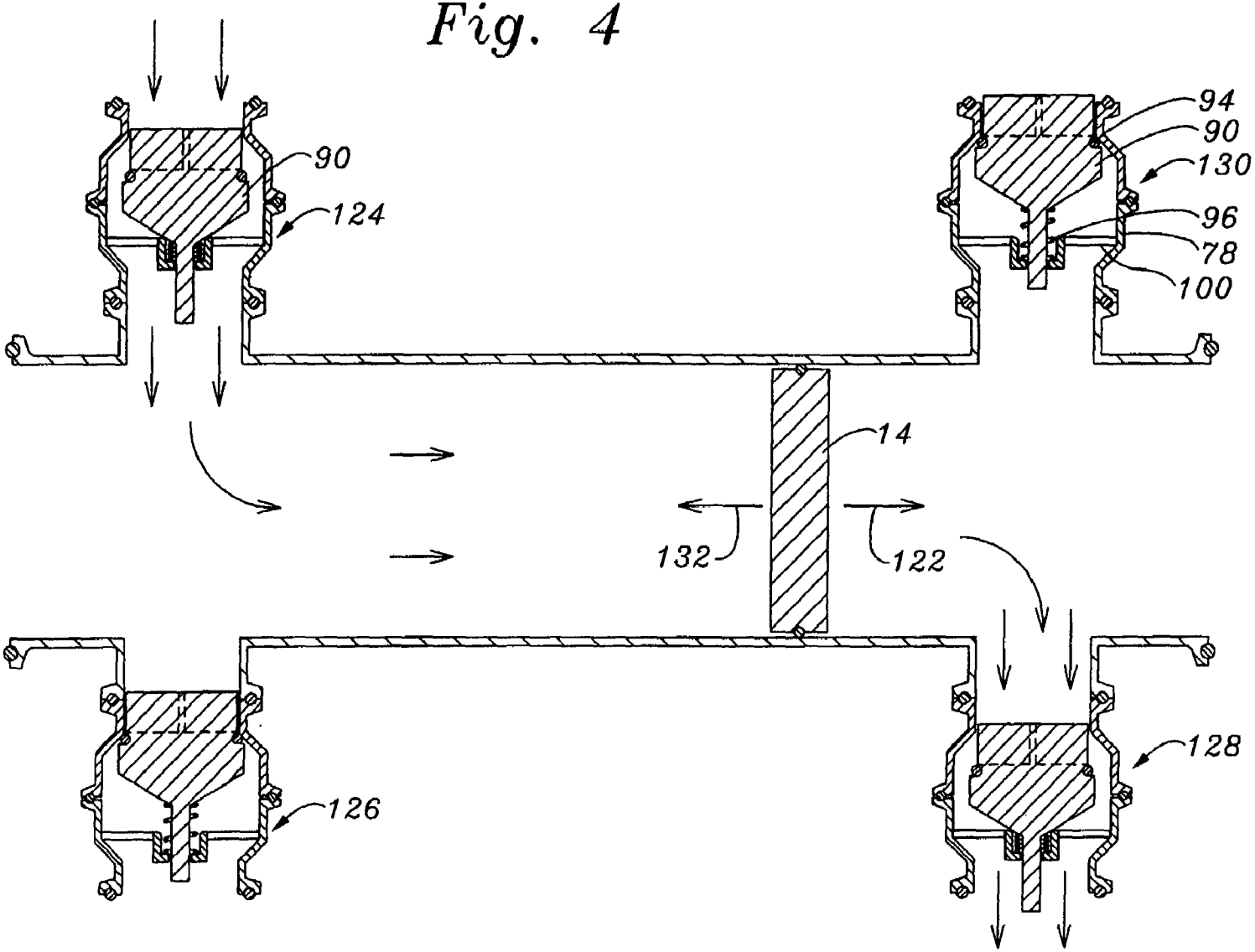
FIG. 4 is a side cut-away diagrammatic view of the operation of the check valves in relation to the piston head.
Figure 6:
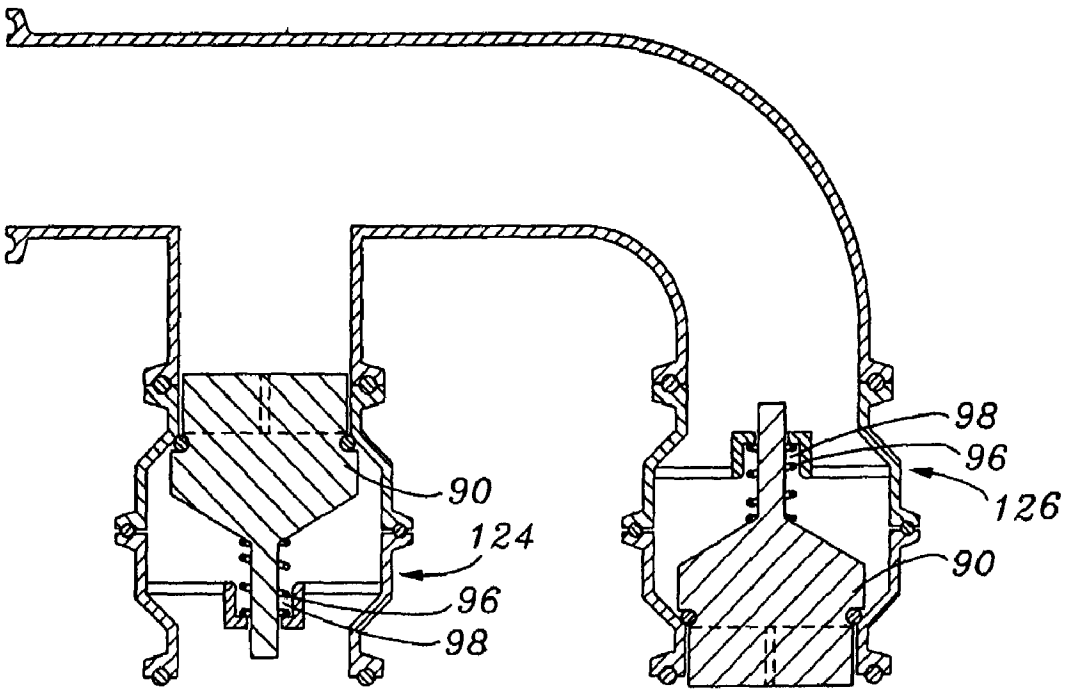
FIG. 6 is a pair of check valves disposed in a manifold of the novel sanitary pump.
Figure 5:
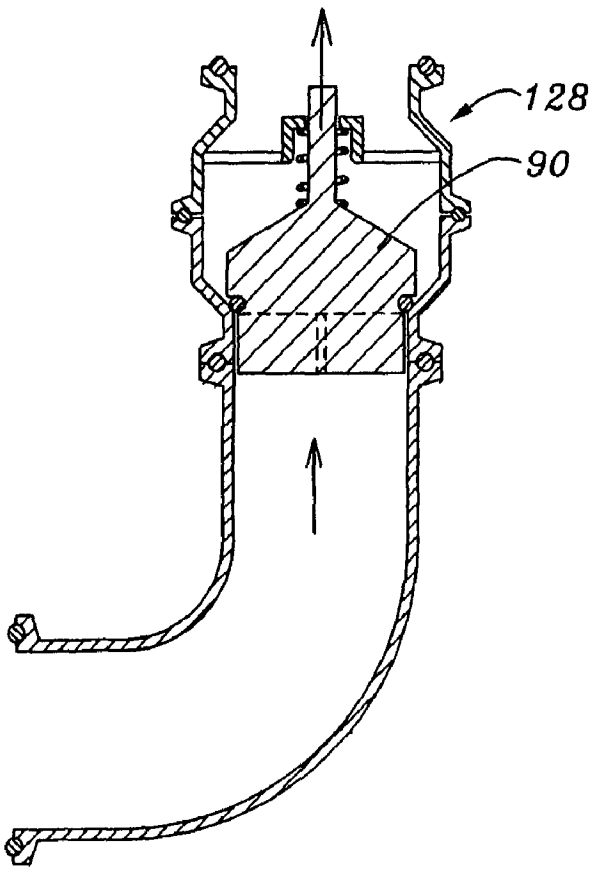
FIG. 5 is a cross-sectional view of a novel check valve in a manifold of the novel sanitary pump.
Figure 8:
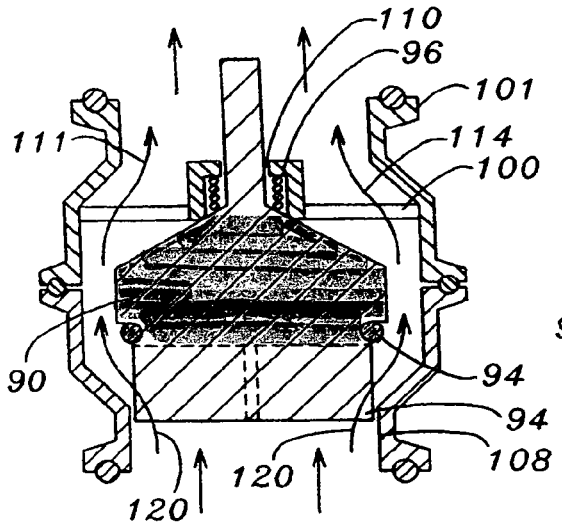
FIG. 8 is a cross sectional view similar to FIG. 7 illustrating the novel sanitary check valve in an open position.
Figure 7:
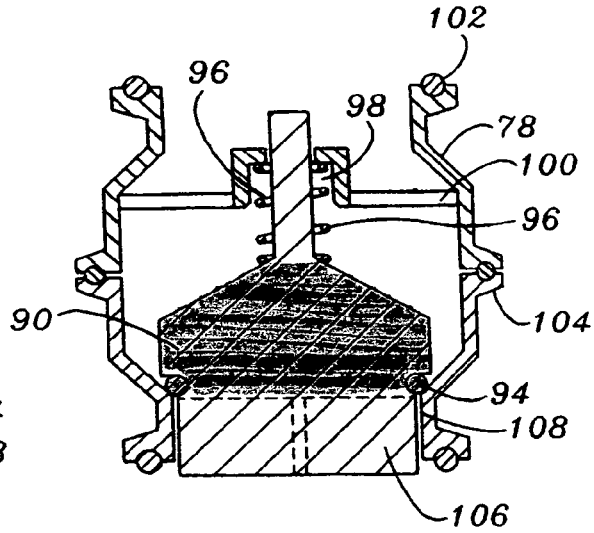
FIG. 7 is a cross sectional view of the novel sanitary check valve of the novel sanitary pump in a closed position.
Figure 9:
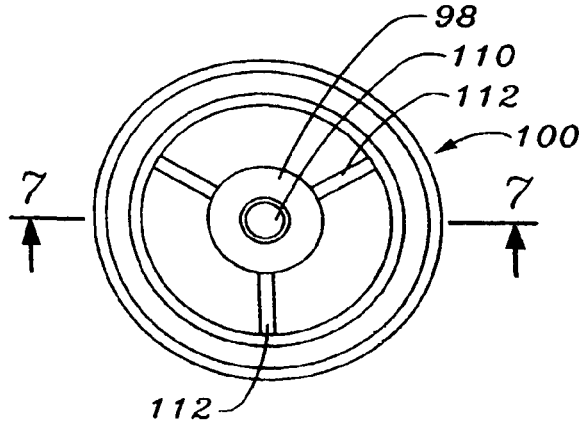
FIG. 9 is a bottom plan view of the valve stem guide of the novel check valve of FIG. 7.
Figure 10:
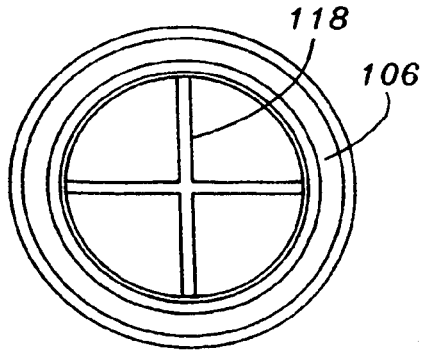
FIG. 10 is a bottom plan view of the check valve seat of FIG. 7.
Figure 11:
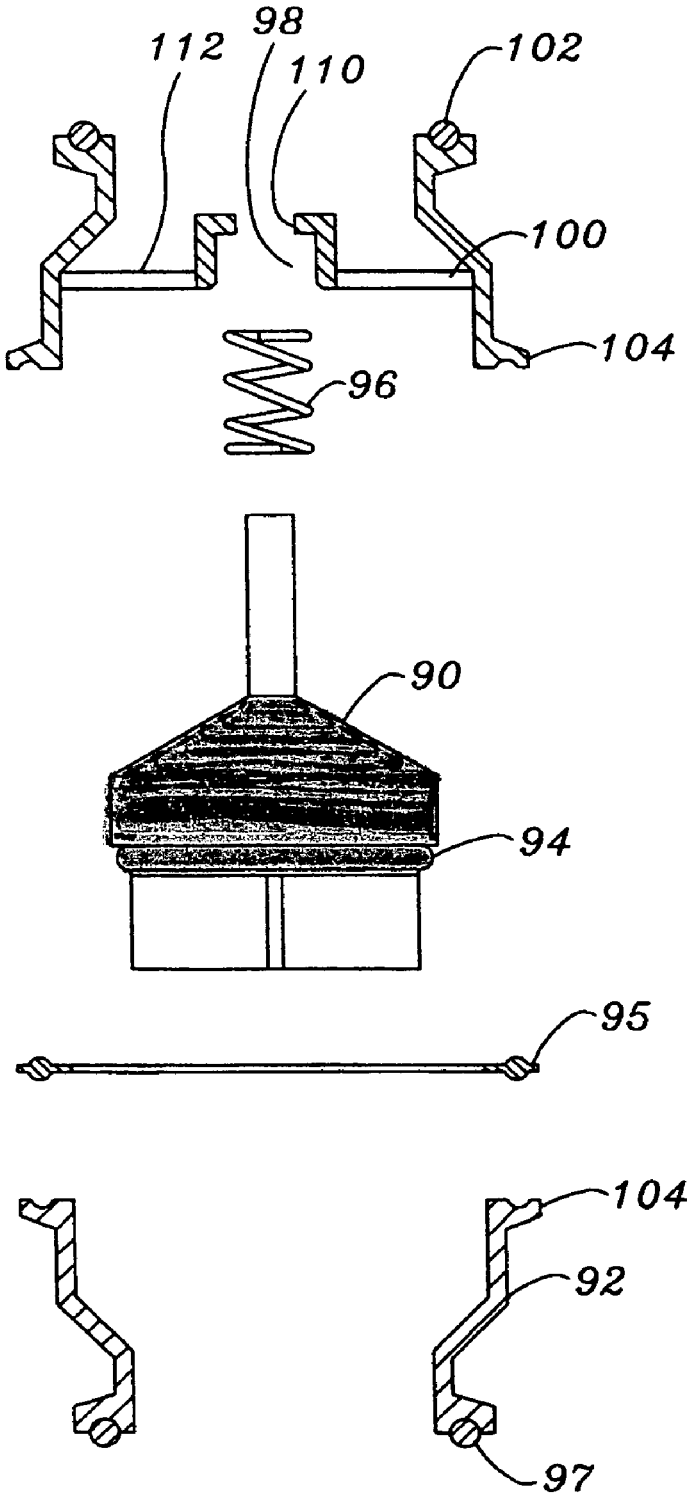
FIG. 11 is an exploded view of the novel sanitary check valve of FIG. 7 of the novel sanitary pump.

The operation of the check valves in the novel sanitary pump 10 is best illustrated in FIGS. 3–6 and particularly FIG. 4 in which movement of piston 14 in the direction of arrow 122 causes outlet check valve 128 to open and forces inlet check valves 130 to close. At the same time, the action of double acting piston 14 results in outlet check valve 126 to close and forces inlet check valve 124 to open. Once the stroke of piston head 14 is complete, piston head 14 moves in the direction of arrow 132 causing outlet check valve 128 to close and inlet check valve 130 to open while at the same time forcing inlet check valve 124 to close and outlet check valve 126 to open. The motion of piston head 14 is positively controlled by drive shaft 16 to positively maintain control over fluids entering and exiting the novel sanitary pump 10 without the necessity of relying upon compressibility of the fluid to drive piston head 14.

The fact that piston head 14 is positively controlled is of significant advantage in not having lead and lag time in operation as it does not rely upon compressibility of the fluid for operation, a much greater control is maintained over the fluids pumped by piston head 14. In addition, the positive control over piston head 14 by drive shaft 16 in combination with the check valves eliminates frothing and undue turbulence imparted to the dispensed fluids imparted by feed or dosing pumps to more precisely control and meter dispensed fluids where precise metering is desired. In filling operations in most applications a separate feed of dosing pump is not required. As will be recognized the operation of the double acting sanitary pump 10 provides a constant pressure pump for dispensing fluids in filling and transferring fluid operations.

As heretofore discussed, the novel sanitary pump 10 may be configured in a variety of configurations with right drive and left drive operations as well as the provision for tandem and parallel applications of the novel sanitary pump 10. These configurations and applications of the sanitary pump 10 by way of illustration included in FIGS. 12–14 in which a single drive motor 28 is provided to drive two sanitary pumps, 140 and 142 in a parallel application for increased capacity. Drive motor 28 drives a gear box 144, which is a prior art gear box, such as is available from Leeson Electric Motor of Grafton, Wis. for driving the two novel sanitary pumps 140 and 142. Gear box 144 includes a pair of crank mechanisms 146 and 148 for driving adjustable linkages 150 and 152 adjustably connected via compression nut 52 to two drive shafts 216 and 316 of novel sanitary pumps 140 and 142. In such operations the provision of stabilizing means 152 is provided to stabilize drive shafts 216 and 316 to prevent undue lateral movement and wear on seals 54 and 56 in interchangeably removeable and detachably sealable cylindrical plates 18. Stabilizing means 152 may include confronting wheels 154 and 156 for maintaining drive shaft 216 in a substantial fixed radial position while drive piston 216 reciprocates axially within cylinder 44 of cylindrical housing 12 of sanitary pump 142.

Figure 15:
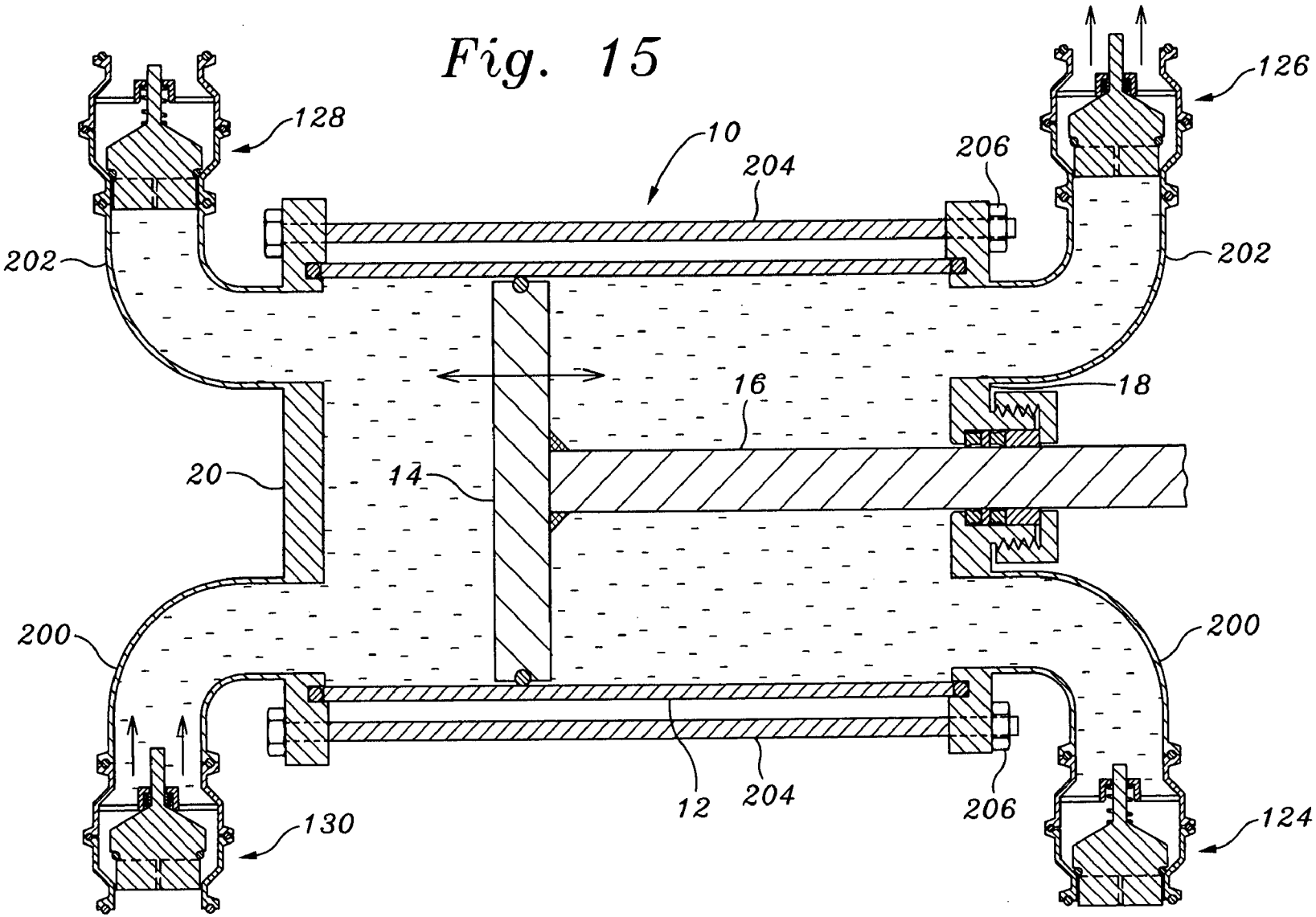
FIG. 15 is a further embodiment of the novel pump illustrating an alternative arrangement of check valves and ports disposed in endplates of the novel pump.

As will be recognized by those skilled in the art the novel sanitary pump 10 may be modified in a number of ways to suit particular applications. One or both inlet and outlet ports disposed in the interchangeable and removeably sealable end plates 18 and 20 as illustrated in FIG. 15. In FIG. 15 end plates 18 and 20 have been modified to include an outlet port 200 and an inlet port 202 with sanitary inlet check valve 124 and sanitary outlet check valve 126 and sanitary inlet check valve 130. The novel sanitary pump substantially cylindrical housing 12 may be closed by removeably sealable end plates 18 and 20 utilizing a plurality of bolts 204 with a plurality of nuts 206. As will be further recognized drive shaft 16 may extend from both sides of piston head 14 and end plate 18 may be used on both ends of cylindrical housing 12 in a configuration similar to the novel sanitary pump 10 as described with reference to FIG. 3.

The novel sanitary pump of the invention may be configured and implemented in a number of ways to achieve the advantages of a constant pressure reliable pump having high capacity, high reliability and easily detachable and easily assembled components for a variety of configurations and operations. It will be recognized that the novel sanitary pump can be utilized in non-sanitary application where the end plates may be threaded into the housing or sealed in various prior art ways in non-sanitary applications. It will be further recognized that the sanitary valves of the novel sanitary pump may be modified and implemented in a number of different ways to achieve the advantages of the invention.

It will be recognized by those skilled in the art the various modifications and substitutions may be made to suit particular requirements and applications, including right hand drive, left hand drives or the utilization of a drive shaft extending from both ends of the piston head and through the end plate of the constant pressure pump. It will be further appreciated that the size of the pump may be changed to various sizes and shapes to fit particular application and implementation of the invention. It will be understood the inlet and outlet ports of the novel pump may be reconfigured in a number of ways on the pump housing or on the endplates. It will also be recognized the check valves may be incorporated into or on the novel pump in a variety of ways and the inlet and outlet check valves may be designed to prevent improper orientation in the novel sanitary pump. It is to be understood that these and other changes may be made by those skilled and with are within the scope of the appended claims.

As used herein and in the following claims the word "comprising," or "comprises" is used in its technical sense to mean the enumerated elements include but do not exclude additional elements which may or may not be specifically included in the appended claims. It will be understood that such additions whether or not made in the dependent claims are modifications that can be made within the scope of the invention. It will be further appreciated by those skilled in the art the wide range of changes and modifications can be made to the invention without parting from the spirit and scope of the invention as defined in the following claims.

What is claimed is:

1. A high-speed, high-pressure sanitary pump machine comprising:

(a) a cylinder housing having removeably sealable ends;

(b) a removable piston provided in said cylinder housing, said piston including a drive shaft having a piston head connected at a first end thereof, said removable piston being removeably mounted to said cylinder housing through a seal in at least one of said removeably sealable ends, wherein motion of said piston head within said cylinder is positively controlled by said drive shaft to positively maintain control over fluids entering and exiting said sanitary pump machine;

(c) a first inlet port and a first outlet port disposed on one side of said piston head;

(d) a second inlet port and a second outlet port disposed on the other side of said piston head;

(e) a check valve having a valve stem guide and a valve seat guide disposed in said first inlet port and said first outlet port and in said second inlet port and said second outlet port; and (f) adjustment means provided at a second end of said drive shaft for adjusting the stroke of said piston in said cylinder housing.

2. The sanitary pump of claim 1, further comprising a compression seal including an O-ring seal with a flat face.

3. The sanitary pump of claim 2, wherein said compression seal further comprises a compression nut threaded to one of said removeably sealable ends for compressing said O-ring seal.

4. The sanitary pump of claim 3, wherein said compression seal includes a pair of O-ring seals with flat faces to provide for compression and wiping against said drive shaft, a compression washer disposed intermediate between said pair of O-ring seals and a bushing disposed between one of said O-ring seals and said compression nut.

5. The sanitary pump of claim 1, wherein said check valve is a sanitary check valve.

6. The sanitary pump of claim 1, wherein said sanitary check valve includes a separate separable check valve housing disposed in said first inlet port, said first outlet port, said second inlet port and said second outlet port with flange clamps.

7. The sanitary pump of claim 6, wherein said separable check valve housing includes a valve seat and a valve guide having means for controlling the radial motion of the check valve.

8. The sanitary pump of claim 7, wherein said check valve includes a stem portion terminating in a conical shaped base for receiving a spring and said check valve housing includes a valve stem guide having a cavity for receiving said spring and limiting the radial motion of said check valve in operation.

9. The sanitary pump of claim 8, wherein said valve stem guide includes a collar for receiving said stem and limiting the radial motion of said check valve in operation.

10. The sanitary pump of claim 8, wherein said check valve includes an O-ring seal and a valve seat guide for fitting within said valve seat of said housing for limiting the radial motion of said check valve in operation.

11. The sanitary pump of claim 8, wherein said separable check valve housing includes flanges for interconnecting said separable check valve housing.

12. The sanitary pump of claim 1, wherein said removeably sealable ends are interchangeable.

13. The sanitary pump of claim 12, wherein both of said removeably sealable ends include a compression seal for said drive shaft.

14. The sanitary pump of claim 1, further comprising a drive mechanism removeably connected to said second end of drive shaft for driving said piston, said drive mechanism including second adjustment means for adjusting the length of said piston head stroke in said cylinder housing via adjusting the length of stroke of said drive mechanism.

15. The sanitary pump of claim 1, wherein said first inlet and said first outlet and said second inlet and said second outlet are disposed in said cylindrical housing.

16. The sanitary pump of claim 1, wherein said first inlet and said first outlet and said second inlet and said second outlet are disposed on said removeably sealable ends.

17. The sanitary pump of claim 1, wherein said first inlet and said second inlet are disposed on said removeably sealable ends and said first outlet and said second outlet are disposed in said cylindrical housing.

18. The sanitary pump of claim 1, wherein said removeably sealable ends are interchangeable and are connected to said cylinder housing by flange clamps.

19. A sanitary pump check valve for operation in a high-speed, high-pressure environment comprising:

(a) a separable check valve housing;

(b) a check valve having a stem with a stem portion terminating in a conical shaped base and a seat portion disposed in said separable check valve housing;

(c) a spring disposed on said conical shaped base of said check valve;

(d) a valve stem guide disposed in said separable check valve housing, said valve stem guide having a cavity therein for receiving said spring and limiting the radial motion of said check valve in operation of said sanitary pump check valve; and (e) a valve seat disposed in said separable check valve housing adjacent to said seat portion of said check valve, said valve seat including a plurality of vanes and openings for allowing fluid to pass around and through the sides of said valve seat.

20. The sanitary pump check valve of claim 19, further comprising a collar disposed in said stem guide to limit radial motion of said check valve.

21. The sanitary pump check valve of claim 19, further comprising an O-ring seal disposed on said check valve intermediate said conical shaped base and said seat portion.

22. The sanitary pump check valve of claim 19, further comprising flanges for interconnecting said separable check valve housing.

23. The sanitary pump check valve of claim 22, further comprising flanges at both ends of said separable check valve housing to provide for alternative orientation capabilities of said separable check valve housing.

24. A sanitary pump comprising:

(a) a housing having a cylinder therein;

(b) removeably sealable endplates for closing the ends of said cylinder;

(c) a piston drive shaft provided in said cylinder, said piston drive shaft having a piston head disposed at a first end of said drive shaft and intermediate said endplates and means for adjusting the stroke of said piston head in said cylinder at a second a second end;

(d) a first pair of openings disposed in said housing disposed on one side of said piston head;

(e) a second pair of openings disposed in said housing on the other side of said piston head;

(f) a drive shaft opening in one of said endplates for reciprocally receiving said piston drive shaft;

(g) a compression seal for sealing around said piston drive shaft and wiping against said drive shaft during operation of said sanitary pump; and (h) sanitary check valves disposed in said first pair of openings and said second pair of openings, said sanitary check valves having a separable housing with flanges at both ends for an interchangeable connection and orientation to said first pair of openings and said second pair of openings, said separable housing including a valve seat and a valve guide having means for limiting the radial motion of the check valve.

25. The sanitary pump of claim 24, wherein said compression seal comprises a pair of O-ring seals.

26. The sanitary pump of claim 24, wherein said sanitary check valve includes a stem portion and means for limiting the radial motion of said stem portion of said check valve.

27. The sanitary pump of claim 24, further comprising a drive mechanism having a shaft connected to said drive shaft for driving said piston drive shaft, said drive mechanism including second adjustment means for adjusting the stroke of said piston head in said cylinder via adjusting the length of stroke of said drive mechanism, said adjustment means comprising a first adjustment nut having an opening for receiving said shaft of said drive mechanism, said shaft of said drive mechanism receiving a second adjustment nut, and a clamp having an O-ring seal for connecting said drive shaft to said shaft of said drive mechanism.

28. The sanitary pump of claim 25, wherein said removeably sealable endplates are interchangeable.

29. The sanitary pump of claim 28, wherein both removeably sealable ends include a compression seal.

30. The sanitary pump of claim 29, wherein one of said first pair of openings and one of said second pair of openings are disposed in said removeably sealable endplates.

31. The sanitary pump of claim 29, wherein said first pair of openings are disposed in one of said removeably sealable endplates and the second pair of openings are disposed in the other of said removeably sealable endplates.

32. The sanitary pump of claim 28, wherein said first pair of openings and said second pair of openings are disposed in said housing.

33. The sanitary pump of claim 28, wherein said one of said first pair of openings and one of said pair of second openings are disposed in said removeably sealable endplates.

34. The sanitary pump of claim 25, further comprising a compression nut adjustably secured to one of said removeably sealable endplates for compressing said seals against said drive shaft.

* * * * *